US006014868A

United States Patent [19]

Hirosawa et al.

[11] Patent Number: 6,014,868

[45] Date of Patent: Jan. 18, 2000

[54] REFRIGERATOR WITH IMPROVED COLD AIR SUPPLY STRUCTURE

[75] Inventors: Masaru Hirosawa; Tomio Suyama; Takatosi Torihata, all of Shimane, Japan

[73] Assignee: Hoshizaki Denki Co., Ltd., Aichi, Japan

[21] Appl. No.: 09/175,567

[22] Filed: Oct. 20, 1998

[51] Int. Cl.[7] ..... F25D 17/04

[52] U.S. Cl. ..... 62/407

[58] Field of Search ..... 62/407

[56] References Cited

U.S. PATENT DOCUMENTS

| | | | |
|---|---|---|---|
| 4,876,860 | 10/1989 | Negishi | 62/179 |
| 4,972,682 | 11/1990 | Smith et al. | 62/405 |
| 5,065,592 | 11/1991 | Takano et al. | 62/180 |
| 5,491,980 | 2/1996 | Yingst et al. | 62/237 |
| 5,729,994 | 3/1998 | Mukaiyama et al. | 62/186 |
| 5,816,060 | 10/1998 | Brownell et al. | 62/186 |

FOREIGN PATENT DOCUMENTS 1791586 10/1993 Japan .

*Primary Examiner*—Henry Bennett
*Assistant Examiner*—Mark Shulman
*Attorney, Agent, or Firm*—Wenderoth, Lind & Ponack, L.L.P.

[57] ABSTRACT

A refrigerator includes a heat insulating body having a front with an opening, a left-hand side, a right-hand side and a ceiling, thereby defining a cold storage compartment, a partition member disposed on either side of the body and having a blowout hole through which cold air is supplied so as to flow along the ceiling, a refrigeration unit including an evaporator and supplying cold air produced by the evaporator through the blowout hole into the cold storage compartment, and a cold air guide member mounted on the ceiling of the body widthwise with respect to the cold storage compartment so as to hang down from the ceiling of the body and to be inclined so that the guide member inwardly retreats as it goes toward a lower end thereof.

6 Claims, 11 Drawing Sheets

REFRIGERATOR WITH IMPROVED COLD AIR SUPPLY STRUCTURE

BACKGROUND OF THE INVENTION

1. Field of the Invention

This invention relates to refrigerators, and more particularly to an improvement in the structure for supplying cold air in such refrigerators.

2. Description of the Prior Art

There has recently been provided a refrigerator including a cold air guide member for desirably diffusing into a cold storage compartment cold air supplied from a blowout duct. In one of such refrigerators, a partition wall is provided for partitioning a cold storage compartment and an evaporator compartment provided at one side of the cold storage compartment. The partition wall has cold air blowout holes in an upper portion thereof and inlets in a lower portion thereof. A square cylindrical cold air guide duct is provided on a ceiling of the cold storage compartment. The guide duct has a side opening located to correspond to the blowout holes so that cold air supplied from the blowout holes is taken into the guide duct.

The guide duct has in a front and backside outlets through which the cold air is supplied into the entire cold storage compartment. After having cooled food in the cold storage compartment, the cold air is circulated through the inlets of the partition wall into the evaporator compartment. In this structure, even when the cold storage compartment is stuffed with food, the cold air guide duct ensures a space for circulation of cold air in the cold storage compartment, so that the cold air can reliably be diffused into the entire cold storage compartment.

However, the conventional refrigerators of the above-described type have the following problems. First, the cold air guide duct has a large size and a complicated structure. As a result, a manufacturing cost of the guide duct is increased and a work for mounting the guide duct is troublesome. Second, since the guide duct has a front panel rising vertically, the user often strikes his or her hand against the front panel when groping for food in the cold storage compartment, for example. Third, the cold air is positively supplied through the outlets formed in the front panel. Accordingly, the cold air is likely to leak out of the refrigerator when a door is opened.

SUMMARY OF THE INVENTION

Therefore, an object of the present invention is to provide a refrigerator in which the structure for ensuring the cold air circulation space can be simplified and the user's hand can be prevented from striking against the front plate when the user gropes for food in the cold storage compartment.

The present invention provides a refrigerator comprises a cold air guide member mounted on a ceiling of a body defining a cold storage compartment widthwise with respect to the cold storage compartment so as to hang down from the ceiling and to be inclined so that the guide member inwardly retreats as it goes toward a lower end thereof. The provision of the cold air guide member ensures a flow path of the cold air near the ceiling of the cold storage compartment even when the compartment is stuffed with food. Consequently, the cold air supplied from a blowout hole is guided by the cold air guide member to thereby be diffused into all the corners of the cold storage compartment.

Furthermore, the cold air guide member is inclined so as to inwardly retreat as it goes toward the lower end thereof.

Consequently, even when the user puts his or her hand into the cold storage compartment, the user's hand can be prevented from striking against the cold air guide member.

BRIEF DESCRIPTION OF THE DRAWINGS

Other objects, features and advantages of the present invention will become clear upon reviewing the description of the preferred embodiments, made with reference to the accompanying drawings, in which.

DETAILED DESCRIPTION OF THE PREFERRED EMBODIMENT

Figure 1:
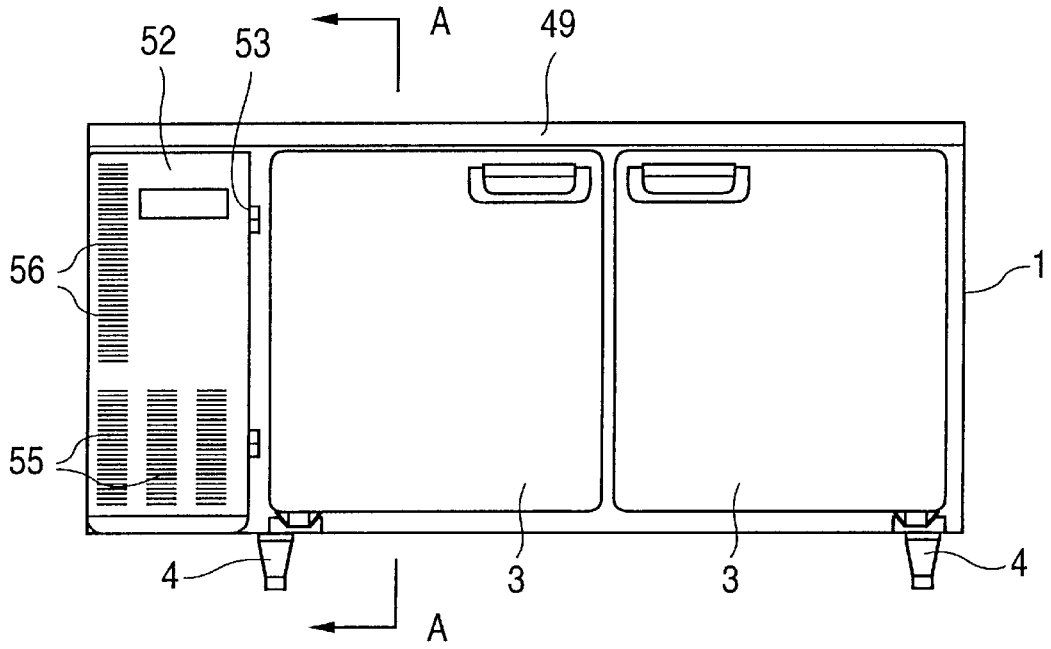
FIG. 1 is a front view of the refrigerator of one embodiment in accordance with the present invention.
Figure 2:
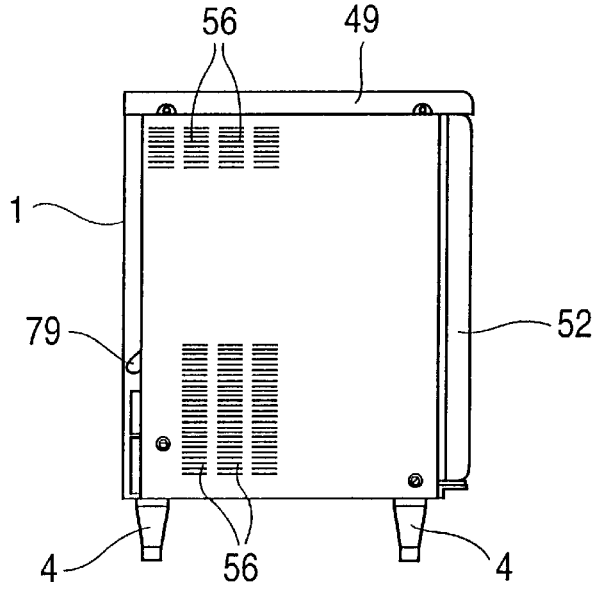
FIG. 2 is a side view of the refrigerator.
Figure 3:
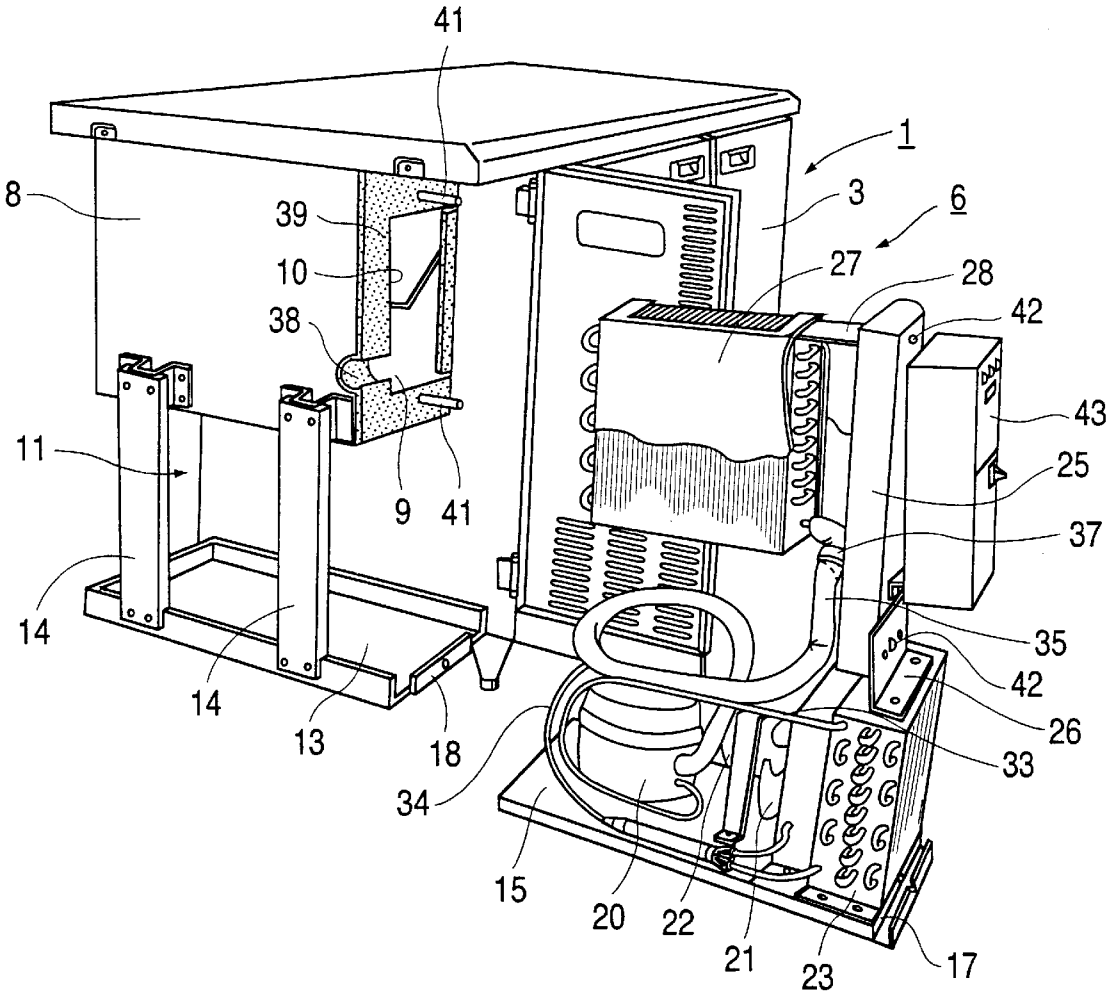
FIG. 3 is a perspective view of the refrigerator, showing the condition before accommodation of the refrigeration unit.
Figure 5:
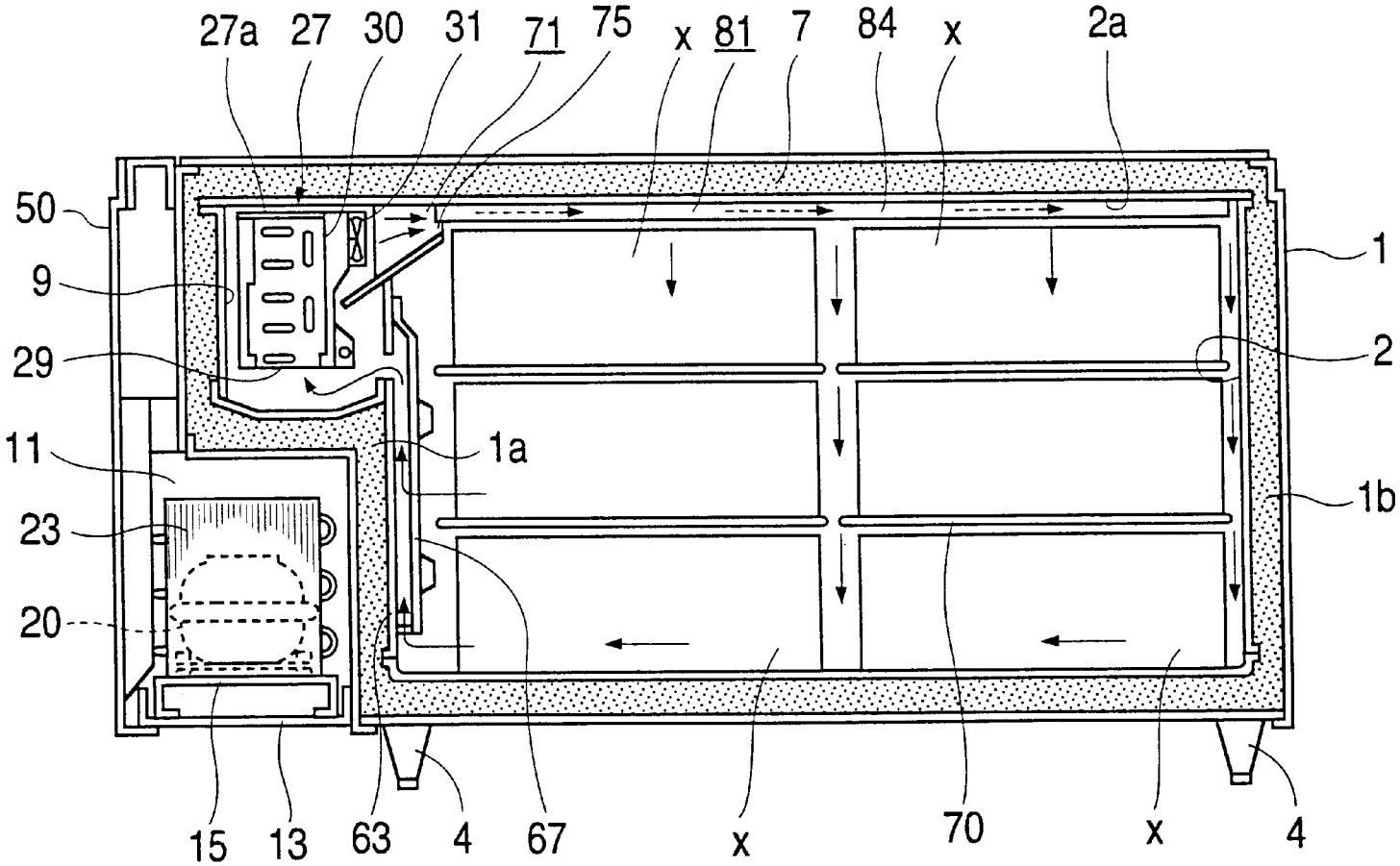
FIG. 5 is a front sectional view of the refrigerator.
Figure 6:
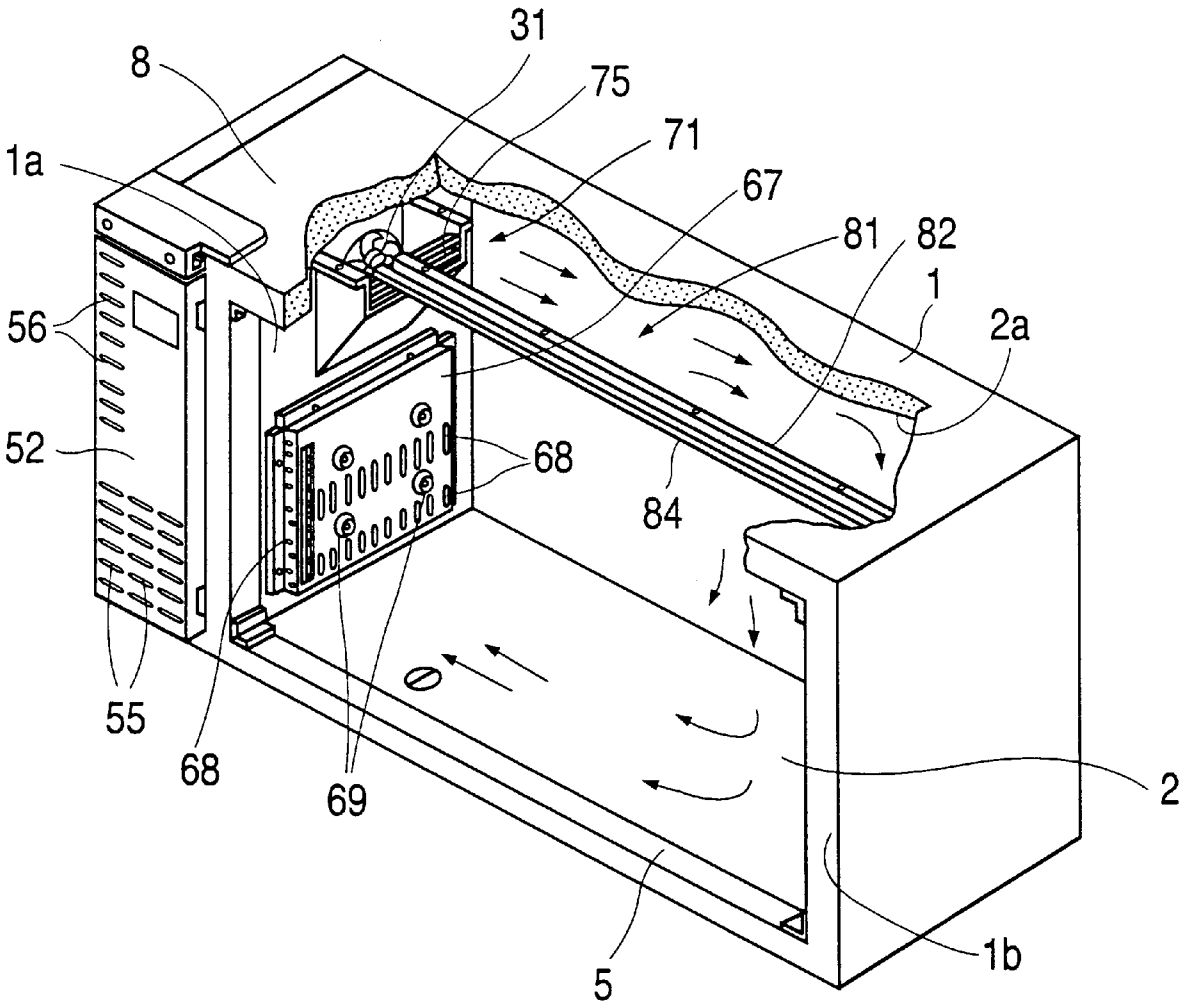
FIG. 6 is a partially cutaway perspective view of the refrigerator, showing the interior thereof.

One embodiment of the present invention will be described with reference to FIGS. 1 to 12. Referring to FIGS. 1 to 3, a refrigerator embodying the invention is shown. The refrigerator comprises a body 1 formed into a box long sideways and having a front opening 5, left-hand and right-hand sides 1*a* and 1*b*. A cold storage compartment 2 for storing food x is defined in the body 1 as shown in FIG. 6. A double-leafed door 3 is hingedly mounted on the front of the body 1 so as to close and open the front opening 5. Legs 4 are mounted on four corners of a bottom of the body 1 respectively to support the body.

A refrigeration unit 6 is drawably accommodated in a compartment (not shown) defined at a left-hand side of the body 1 as viewed in FIG. 1. More specifically, a rectangular parallelepiped box 8 is formed at the upper left-hand side of the body 1 as shown in FIG. 3. The box 8 is formed so as to withdraw from the front of the body 1 by a predetermined dimension. An interior of the box 8 serves as an evaporator compartment 9. Walls defining the body 1 and the box 8 are filled with a heat insulating material 7 so that interiors of the body 1 and the box 8 are insulated from heat, as shown in FIG. 5. A front wall of the evaporator compartment 9 is formed with a front opening 10. An equipment accommodating space 11 is defined beneath the box 8. A compressor 20, a condenser 23, and an evaporator 27 etc. constituting the refrigeration unit 6 are drawably accommodated in the equipment accommodating space 11 and the evaporator compartment 9.

A shallow dish-shaped receiving plate 13 is fixed at one side edge thereof to the lower edge of the left-hand side of the body 1 in the equipment accommodating space 11. A pair of support frames 14 are mounted on front and rear ends of a lower side edge of the box 8 respectively so as to extend downward. The other side edge of the receiving plate 13 is fixed to the lower ends of the support frames 14, whereby the receiving plate 13 is supported. A base panel 15 of the refrigeration unit 6 is to be placed on the receiving plate 13. The base panel 15 has left-hand and right-hand side edges bent so that the base panel is generally formed into a C shape. The base panel 15 is pushed to slide on the receiving plate 13 from the front. The pushing is stopped when an abutment plate 17 provided on the front edge (the right-hand side as viewed in FIG. 3) of the receiving plate 13 abuts a screw receiving strip 18 rising from the central front edge of the receiving plate 13. Both of the abutment plate 17 and the screw receiving strip 18 are screwed together so that the base panel 15 is fixed.

Figure 7:
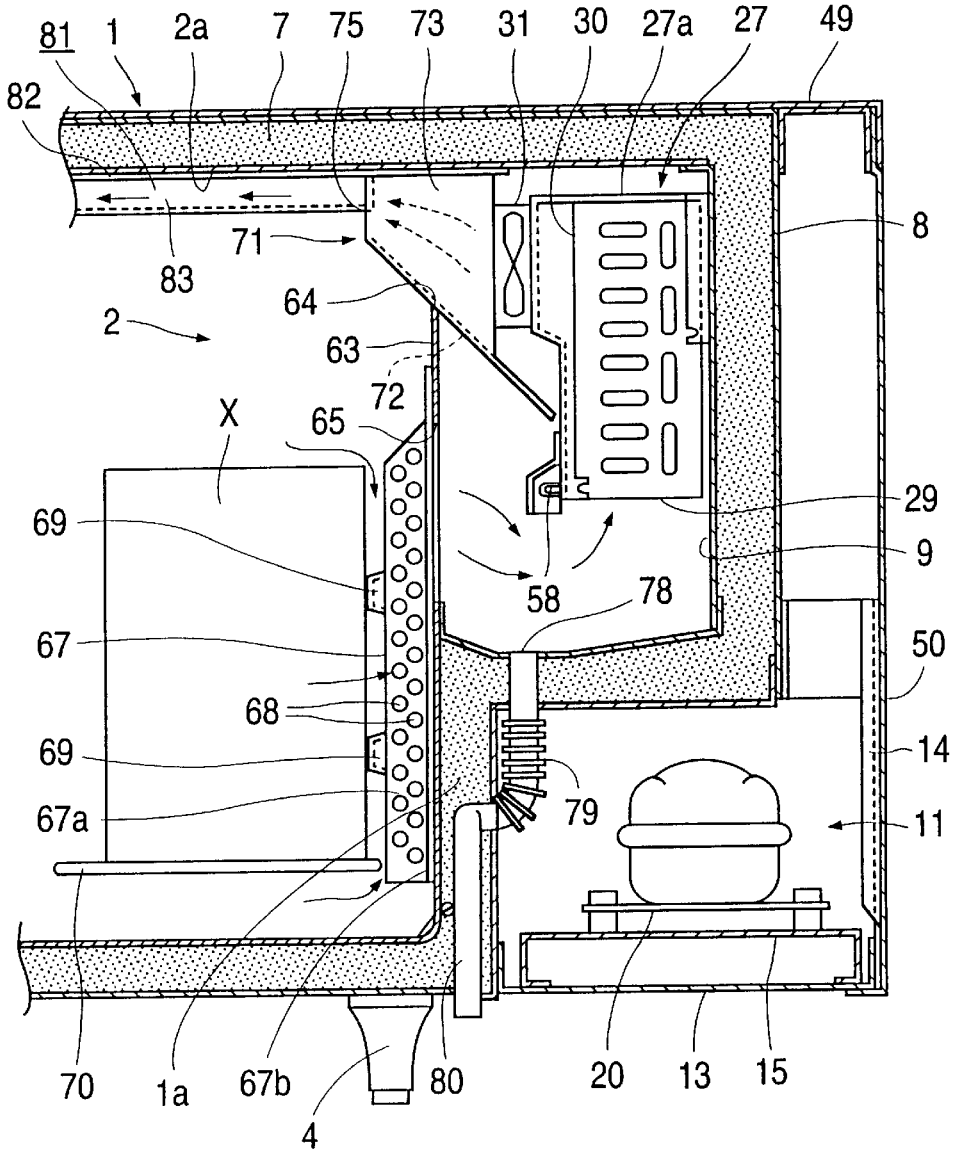
FIG. 7 is an enlarged rear sectional view of the refrigerator, showing the structure of the evaporator compartment.
Figure 8:
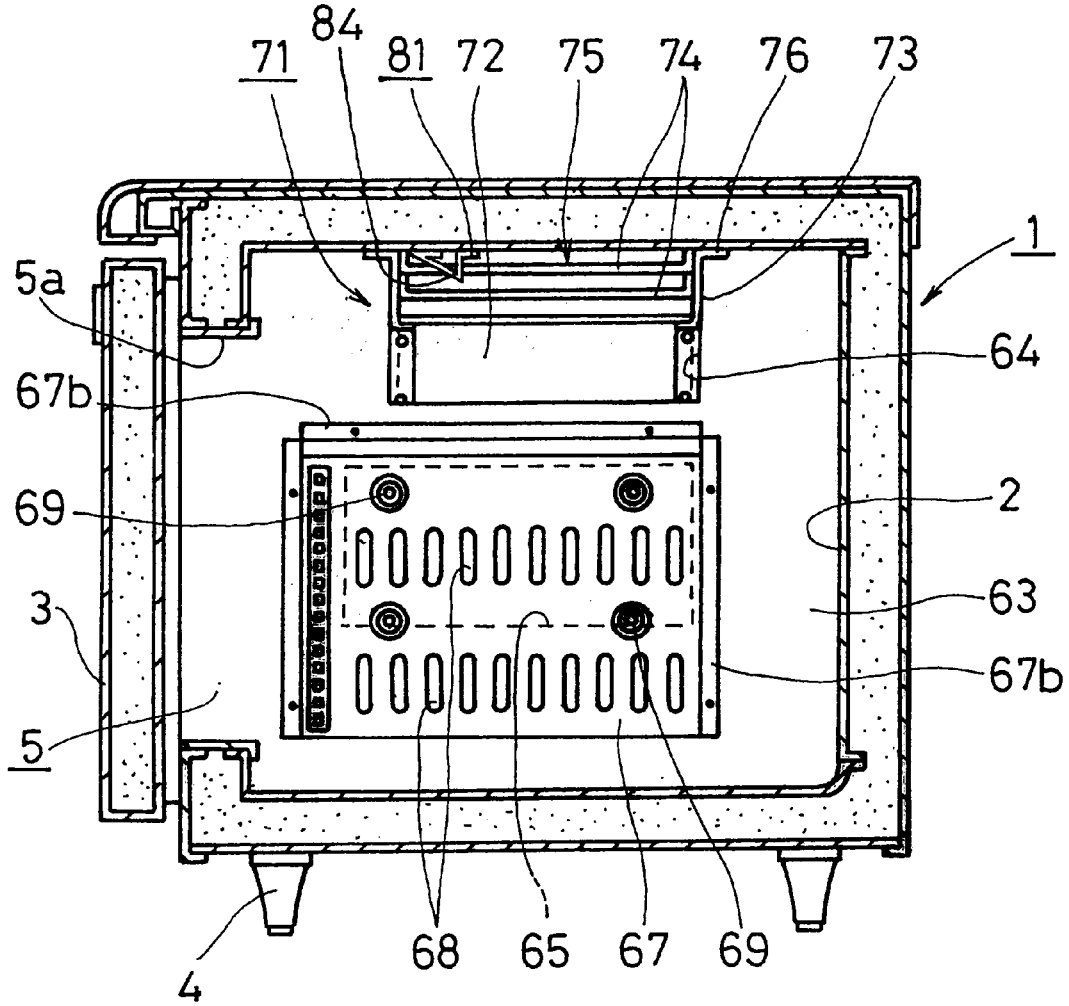
FIG. 8 is a sectional view taken along line 8—8 in FIG. 1.
Figure 9:
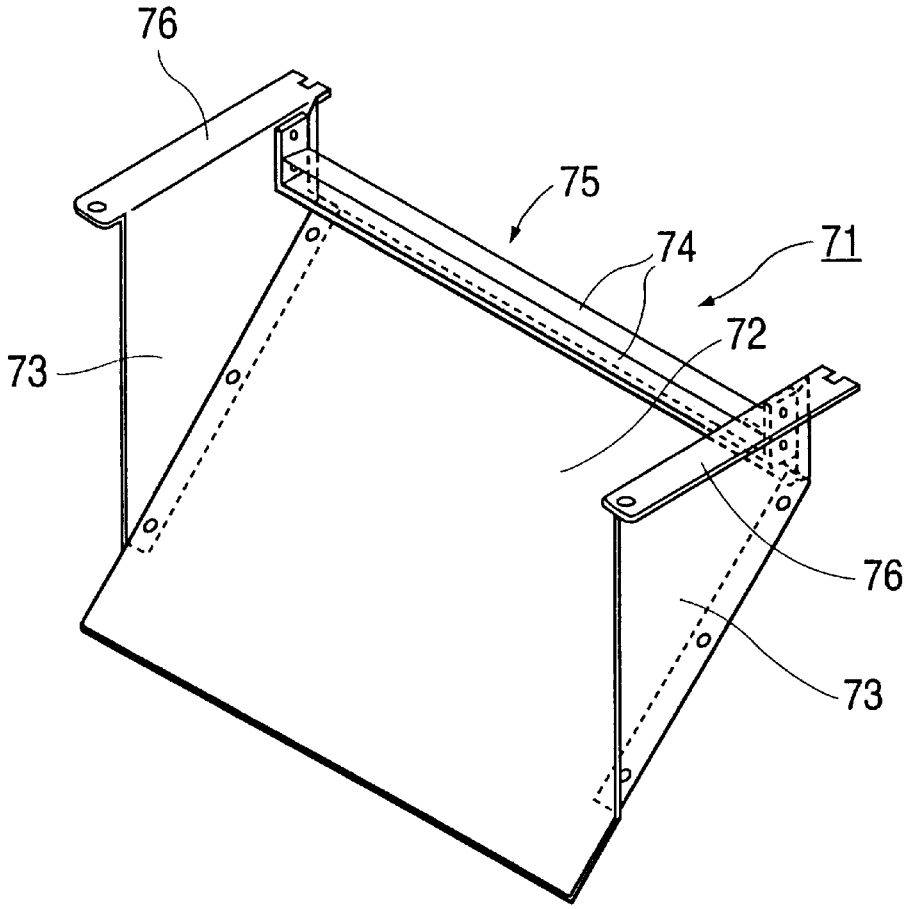
FIG. 9 is a perspective view of the blow-off duct.

The refrigeration unit 6 is divided into components or equipment to be accommodated in the equipment accommodating space 11 and components or equipment to be accommodated in the evaporator compartment 9. These components are stacked on the base panel 15. The components to be accommodated in the equipment accommodating space 11 include an innermost compressor 20, a condenser fan 21 driven by an electric motor 22 and disposed in front of the compressor 20, a condenser 23 disposed in the forefront. An evaporator compartment cover 25 is fixed to an L-shaped bracket 26 further fixed to the top of the condenser 23. The cover 25 is provided for closing the front opening 10 of the evaporator compartment 9. An evaporator 27 is fixed to a bracket 28 further fixed to the backside of the cover 25. The evaporator 27 is capable of being taken into and out of the evaporator compartment 9. The evaporator 27 is enclosed in a casing 27*a*. The bottom and an upper portion of one side of the casing 27*a* facing the cold storage compartment 2 are open, which openings serve as an air inlet 29 and an air outlet 30 respectively, as shown in FIGS. 5 and 7. A compartment fan 31 is provided in the air outlet 30.

Referring to FIG. 3, a pipe 33 connects between an outlet of the compressor 20 and an inlet of the condenser 23. A pipe 34 connects between an outlet of the condenser 23 and an inlet of the evaporator 27. Furthermore, a pipe 35 connects between an outlet of the evaporator 27 and an inlet of the compressor 20. As a result, a refrigerating cycle is constituted as well known in the art. The pipes 34 and 35 both connected to the evaporator 27 are bundled en route and covered with a tube made of a heat insulating material together, being drawn out sideways from the left-hand edge of the cover 25. Portions of the pipes 34 and 35 drawn out of the cover 25 are fixed by a semicircular pressing member 37. The evaporator compartment 9 has in a side edge of the front thereof a recess 38 into which the pressing member 37 is fitted.

A heat insulating packing 39 is attached to the peripheral edge of the front opening 10 of the front wall of the evaporator compartment 9 including the recess 38. A pair of stud bolts 41 protrude from the upper and lower edges of the front wall of the evaporator compartment 9 respectively. The cover 25 is formed with bolt insertion holes 42 for the respective stud bolts 41. An electrical parts box 43 is mounted on the front side of the cover 25.

The base panel 15 is pushed onto the receiving plate 13 as described above and the evaporator 27 is accommodated through the front opening 10 into the evaporator compartment 9. The stud bolts 41 are inserted into the respective insertion holes 42 in the midst of the pushing. When each stud bolt 41 is inserted into the corresponding hole 42 until it assumes a predetermined location, the heat insulating packing 39 of the cover 25 abuts the front wall of the evaporator compartment 9 with the pressing member 37 being fitted into the recess 38. Furthermore, nuts (not shown) are engaged with the protruding ends of the stud bolts 41 having passed through the cover 25, being tightened up. Consequently, the cover 25 airtightly closes the front opening 10 of the evaporator compartment 9. The base panel 15 is fixed to the receiving plate 13 in the manner as described above. Thus, the evaporator 27 is accommodated in the evaporator compartment 9, and the compressor 20, the condenser fan 21 and the condenser 23 are accommodated in the equipment accommodating space 11.

Figure 4:
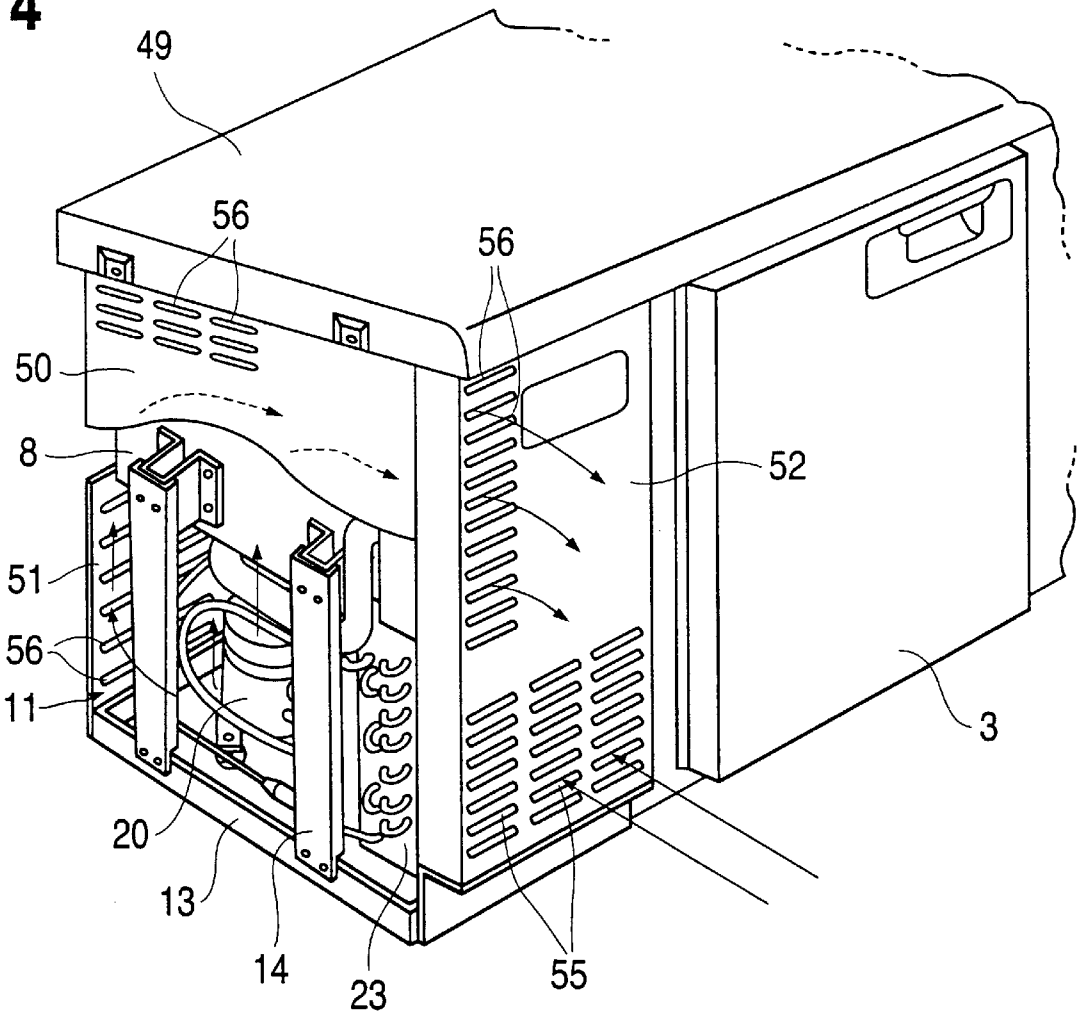
FIG. 4 is a partially cutaway perspective view of the refrigerator, showing a flow of hot exhaust air.

A top plate 49 extends over the body 1 including the box 8 as shown in FIG. 4. A side panel 50 is mounted so as to cover both the evaporator compartment 9 and the side of the equipment accommodating space 11. A back panel 51 is also mounted at the rear side. Furthermore, a front panel 52 is mounted on hinges 53 fixed to the front of the evaporator compartment 9 and the equipment accommodating space 11 so as to be thereby opened and closed. The front panel 52 has in its lower portion a plurality of outside air inlets 55 and in its upper portion an exhaust hole 56 formed to correspond to a space between the side wall of the evaporator compartment 9 and the side panel 50. The side panel 50 and the back panel 51 also have respective exhaust holes. Accordingly, during a refrigerating operation, the condenser fan 21 is driven so that outside air is drawn through the inlets 55 into the equipment accommodating space 11 as shown by arrows in FIG. 4, whereby condenser 23 is cooled. Hot air resulting from heat exchange is discharged outside through the exhaust holes 56.

The interior structure of the refrigerator will now be described. Referring to FIGS. 5 to 8, a partition plate 63 is provided between the cold storage compartment 2 and the evaporator compartment 9. The partition plate 63 rises from the side wall 1*a* of the body 1 partitioning the equipment accommodating space 11 and the cold storage compartment 2. The partition plate 63 has a notch 64 used to install a cold air blowout duct 71 in the central portion thereof at the ceiling side as will be described later. The partition plate 63 further has a window opening 65 formed substantially in the center thereof. The window opening 65 is located substantially at the same level as the inlet 29 of the evaporator 27 accommodated in the evaporator compartment 9.

A cover 67 is mounted on one side of the partition plate 63 at the cold storage compartment side. The cover 67 has side plates 67*a* on upper, left-hand and right-hand sides respectively and is open at a lower end thereof. Each side plate 67*a* has a flange 67*b* screwed to the partition plate 63 so that the cover 67 covers the window opening 65 and a portion of the partition plate 63 lower than the window opening. The cover 67 has upper and lower rows of suction holes 68 formed over the width thereof, each row including a plurality of suction holes. Each of the left-hand and right-hand side plates 67*a* also has a plurality of suction holes 68. The cover 67 has four protrusions 69 formed on the front thereof. When food x carried on a rack etc. is put into the cold storage compartment 2 and comes near to the cover 67 as shown in FIG. 7, the food x abuts the protrusions 69 such that a space is ensured between the front of the cover and the food.

The blowout duct 71 comprises a guide plate 72 having a rising gradient toward a front end thereof (the cold storage compartment 2 side), a pair of side plates 73 secured to opposite side edges at the front end side of the guide plate 72 so as to rise from the side edges, and two reinforcing plates 74 secured to the side plates 73 at a location slightly inward from front edges of the side plates so that the reinforcing plates 74 are vertically spaced from each other, whereby a blowout hole 75 is formed. The blowout duct 71 is fitted in the notch 64 formed in the side of the partition plate 63 at the ceiling side so that the blowout hole 75 is directed to the cold storage compartment 2 side. The side plates 73 have on upper edges respective flanges 76 which are screwed to the ceiling, whereby the duct 71 is fixed.

Upon start of the refrigerating operation, the compartment fan 31 is driven so that air in the cold storage compartment 2 is drawn through the suction holes 68 of the cover 67 and the window opening 65 of the partition plate 63 into the inlet 29 at the backside of the evaporator 27, as shown by arrows in FIG. 7. The drawn air is cooled by the evaporator 27, being supplied into the blowout duct 71 by the compartment fan 31. The cold air is further supplied from the blowout hole 75 toward the ceiling of the cold storage compartment 2.

When a heater 58 provided in the evaporator 27 is energized for a defrosting operation, defrost water drops from the evaporator 27 and the blowout duct 71 onto the bottom of the body 1. The defrost water is discharged through a drain hole 78 formed in the bottom, a pipe 79 and a drain pipe 80 provided in the side wall 1*a* outside.

Figure 10:
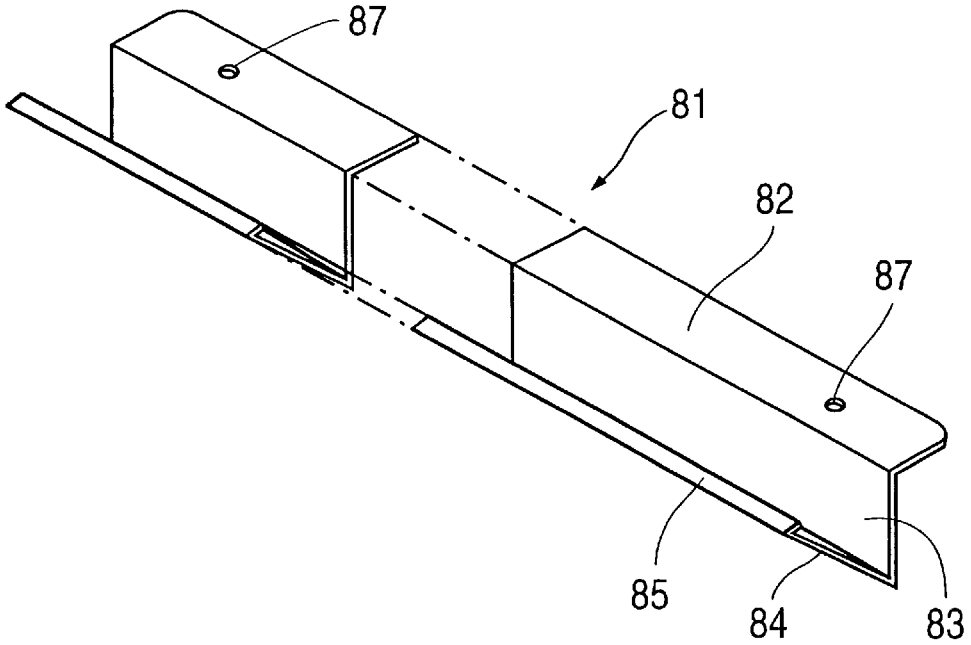
FIG. 10 is a partially cutaway perspective view of the cold air guide duct.
Figure 11:
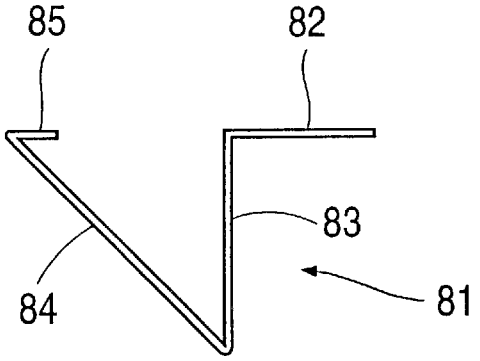
FIG. 11 is a side view of the guide duct.

A cold air guide member 81 is provided for diffusing the cold air supplied from the duct 71 to the interior of the cold storage compartment 2. The cold air guide member 81 is formed into a shape as shown in FIGS. 10 and 11 by pressing. As shown in FIG. 5, the guide member 81 has a full length from the blowout hole 75 of the duct 71 to the opposite side of the cold storage compartment 2. The guide member 81 includes a horizontal mounting portion 82 located at an inner side of the cold storage compartment 2 (at the right-hand side as viewed in FIG. 11) and a vertical portion 83 formed by downwardly bending a front end side of the mounting portion 82 at right angles thereto. The vertical portion 83 has a lower end obliquely forwardly bent so that the lower end reaches a position of the mounting portion 82, whereby the lower end of the vertical portion 83 is formed into an inclined portion 84. The inclined portion has a distal end inwardly folded back to be formed into a folded portion 85.

Figure 12:
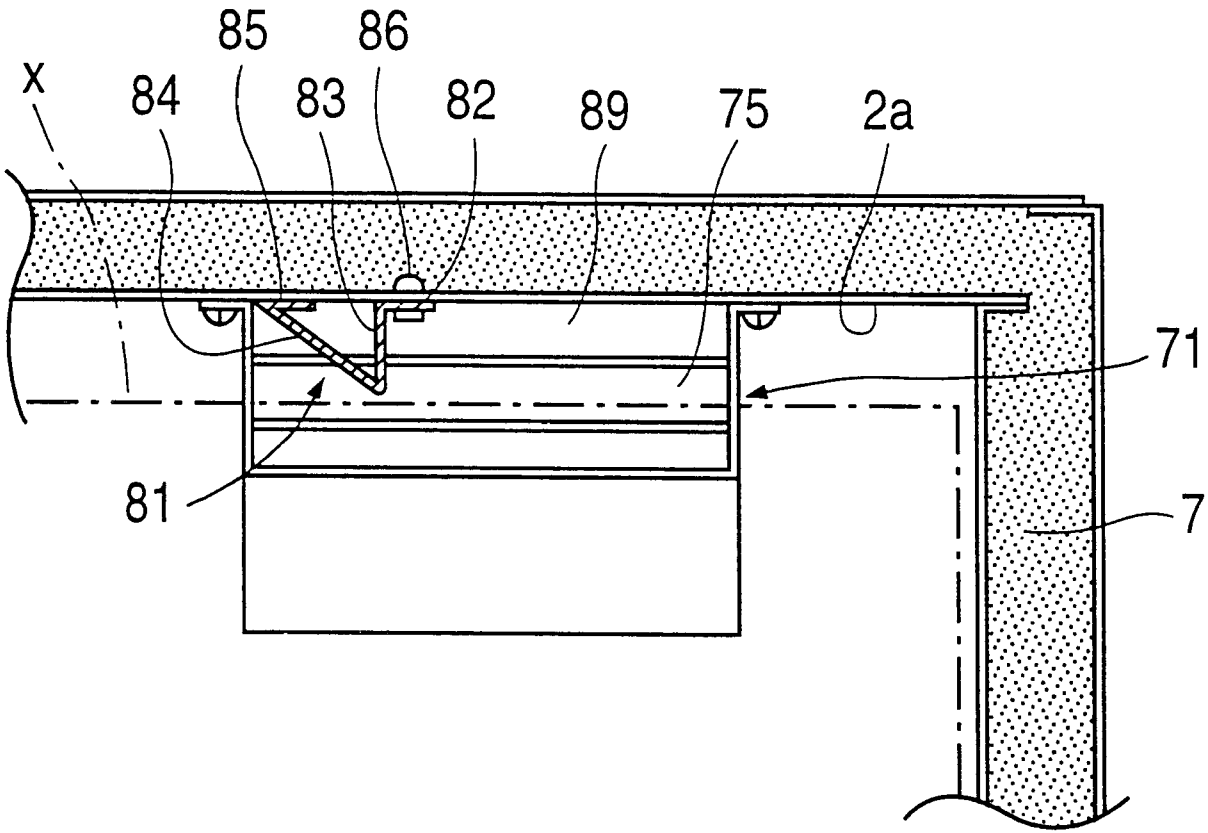
FIG. 12 is a sectional view showing the guide duct mounted in the cold storage compartment.
Figure 13:
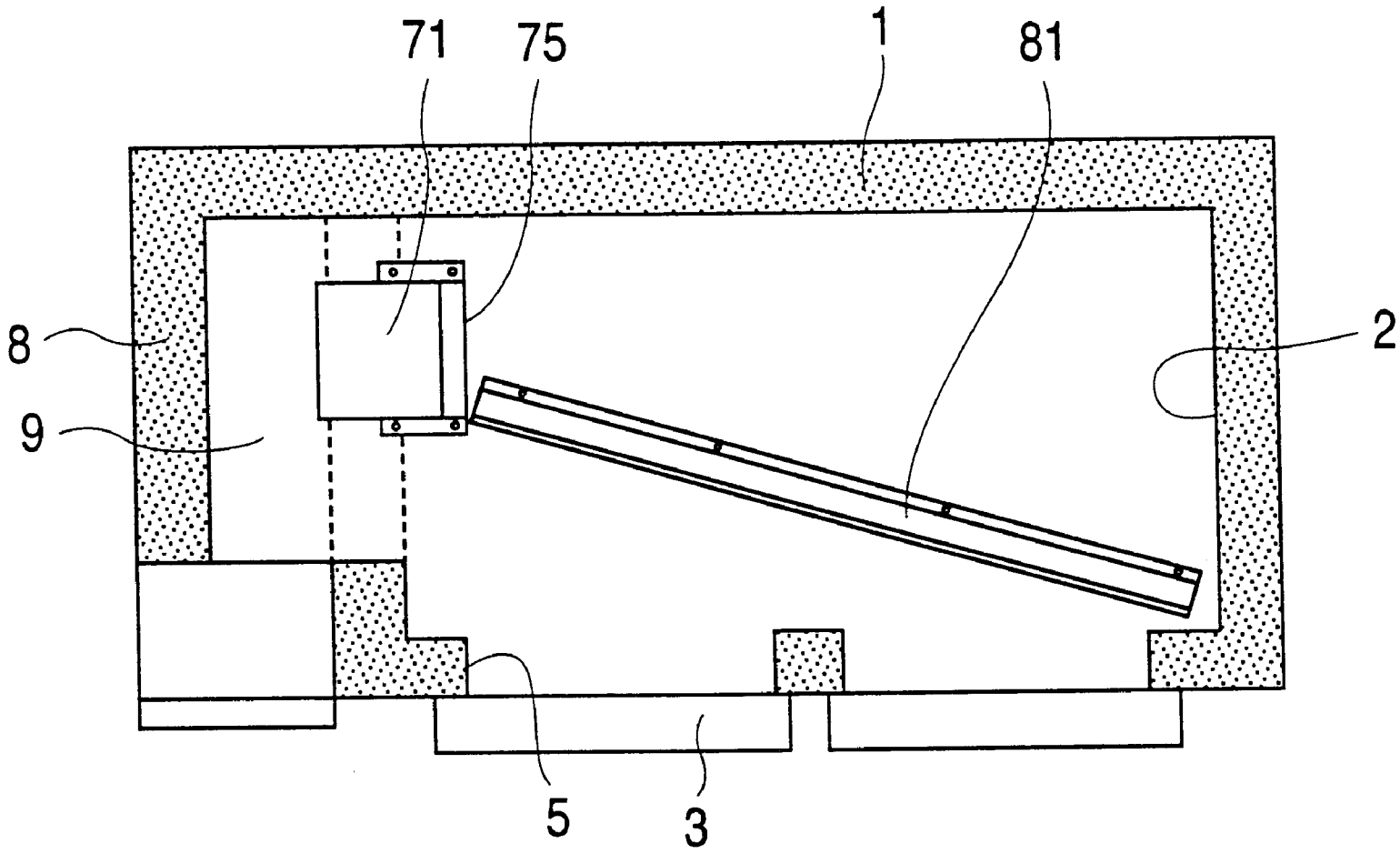
FIG. 13 is a top sectional view of the refrigerator of a modified form in accordance with the invention.

The mounting portion 82 has mounting holes 87 formed at suitable intervals lengthwise. Rivets 86 are driven into the mounting holes 87 respectively as shown in FIG. 12. The vertical portion 83 has a vertical dimension approximately equal to one half of a vertical dimension of the blowout hole 75 of the duct 71 as shown in FIG. 12. A depth between the forward end of the inclined portion 84 and the vertical portion 83 is approximately a quarter of a horizontal dimension of the blowout hole 75.

The cold air guide member 81 is mounted along the ceiling 2*a* at a location of a corner over the front end side of the blowout hole 75 of the duct 71. More specifically, the mounting portion 82 and the folded portion 85 are abutted against the ceiling 2*a* with one end of the guide member 81 being fitted slightly into the blowout hole 75. The rivets 86 are driven into the mounting holes 87 of the mounting portion 82 so that the guide member 81 is fixed to the ceiling 2*a*. Thus, the cold air guide member 81 is provided to extend from the upper corner at the forward end side of the blowout hole 75 toward the front of the cold storage compartment 2 and to reach the opposite side. The inclined portion 84 retreating inward gradually toward its lower end is directed to the front of the cold storage compartment 2. A downwardly protruding end of the guide member 81 is drawn back above an upper opening edge 5*a* of the front opening 5 through which the food x is taken into and out of the cold storage compartment 2.

The operation of the refrigerator will now be described. When the cold storage compartment 2 is stuffed with the food x as shown in FIG. 5, for example, the food accommodated at an uppermost stage is blocked by the cold air guide member 81. Accordingly, as shown in FIG. 12, the food x can be accommodated so as to be located just below the guide member 81. As a result, a cold air circulating space 89 is ensured between an upper face of the food x and the ceiling 2*a* at the side of the rear of the guide member 81. The cold air supplied from the blowout hole 75 of the duct 71 diffuses through the circulating space 89 along the entire width of the ceiling 2*a* of the cold storage compartment 2 as shown by arrows in FIGS. 5 and 6. The cold air thus flows between the food x and is then drawn to the evaporator compartment 9 side, whereby the cold air is circulated.

According to the above-described embodiment, the cold air can reliably be diffused into the cold storage compartment 2 even when the compartment is stuffed with the food x. Consequently, the food x can desirably be refrigerated.

The cold air guide member 81 can readily be formed by pressing a metal plate and accordingly made at low cost. The cold air guide member 81 has the rearwardly protruding mounting portion 82 which is secured to the ceiling 2*a* by the rivets 86. Thus, the guide member 81 can readily be mounted. Furthermore, the front side of the cold air guide member 81 is inwardly obliquely inclined into the inclined portion 84. Accordingly, a shock the user's hand receives from the cold air guide member 81 is small even when the user has struck his or her hand against the cold air guide member 81 while groping for food in the cold storage compartment, for example. Moreover, since the cold air guide member 81 is mounted so as to be drawn back above the upper opening edge 5*a* of the front opening 5, the food x can be prevented from colliding against the cold air guide member 81 and being deformed when put through the opening 5*a* into the cold storage compartment 2. Additionally, the cold air guide member 81 has no blowout holes open at the front side thereof. Consequently, the cold air can be prevented from leaking out of the cold storage compartment 2 when the door 3 is opened.

In a modification, the cold air guide member 81 may be mounted on the ceiling 2*a* so as to extend from the blowout hole 75 toward the opposite side widthwise with respect to the cold storage compartment 2 and so as to come nearer to the front opening 5 of the cold storage compartment 2 as it approaches the side opposite the blowout hole 75.

Although the invention has been applied to the refrigerator of the type in which the refrigeration unit is drawable, it may be applied to a refrigerator of the type in which an evaporator is fixedly provided in an evaporator compartment defined at one side of a cold storage compartment.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

We claim:

1. A refrigerator comprising:

a heat insulating body having a front opening closed and opened by a door and provided with a left-hand side, a right-hand side and a ceiling, thereby defining a cold storage compartment;

a partition member provided on either side of the body and having a blowout hole through which cold air is supplied so as to flow along the ceiling;

a refrigeration unit including an evaporator and supplying cold air produced by the evaporator through the blowout hole into the cold storage compartment; and a cold air guide member mounted on the ceiling of the body widthwise with respect to the cold storage compartment so as to hang down from the ceiling of the body and to be inclined so that the guide member inwardly retreats as it goes toward a lower end thereof.

2. A refrigerator according to claim 1, wherein the cold air guide member has a mounting portion and a vertical portion formed by downwardly bending a front end side of the mounting portion at right angles to the mounting portion, wherein the vertical portion has a lower end obliquely forwardly bent so that the lower end reaches a position of the mounting portion, whereby the lower end of the vertical portion is formed into an inclined portion, and wherein the inclined portion has a distal end inwardly folded back to be formed into a folded portion, the mounting portion and the folded portion being abutted against the ceiling of the body so that the cold air guide member is mounted on the ceiling.

3. A refrigerator according to claim 2, wherein the partition member has a window opening formed in a lower portion thereof so that air in the cold storage compartment is taken through the window opening into an evaporator side, and which further comprises a cover mounted on the partition member for covering the window opening, the cover being formed with a plurality of inlet openings.

4. A refrigerator according to claim 3, wherein the cover is provided with a protrusion protruding into the cold storage compartment.

5. A refrigerator according to claim 4, wherein the partition member includes a partition plate and a cold sir blowout duct provided over the partition plate, and the blowout duct includes a guide plate having a rising gradient toward a front end thereof, a pair of side plates secured to opposite side edges at the front end side of the guide plate so as to rise from the side edges, and a plurality of reinforcing plates secured to the side plates at a location slightly inward from front edges of the side plates so that the reinforcing plates are vertically spaced from each other, whereby a louver blowout hole is formed.

6. A refrigerator according to claim 1, wherein the cold air guide member is mounted so as to extend from the blowout hole toward the side of the body opposite the blowout hole widthwise with respect to the cold storage compartment and so as to be oblique so that the guide member approaches the front opening of the cold storage compartment as the same comes nearer to the opposite side of the body.

* * * * *